US006748779B2

(12) United States Patent
Allart et al.

(10) Patent No.: US 6,748,779 B2
(45) Date of Patent: Jun. 15, 2004

(54) TANGENTIAL ROLLING ATTACHMENT FOR A MACHINE TOOL

(75) Inventors: Paul W. Allart, Rochester, NY (US); Sandro G. Belpanno, Rochester, NY (US); Liberato Pietrantoni, Rochester, NY (US)

(73) Assignee: C.J. Winter Machine Technologies, Inc., Rochester, NY (US)

( * ) Notice: Subject to any disclaimer, the term of this patent is extended or adjusted under 35 U.S.C. 154(b) by 36 days.

(21) Appl. No.: 10/261,025

(22) Filed: Sep. 30, 2002

(65) Prior Publication Data

US 2004/0060335 A1 Apr. 1, 2004

(51) Int. Cl.[7] ..... B21H 3/04
(52) U.S. Cl. ..... 72/104; 72/108; 72/121
(58) Field of Search ..... 72/102, 104, 108, 72/120, 121

(56) References Cited

U.S. PATENT DOCUMENTS 4,924,687 A * 5/1990 Francia ..... 72/102
5,167,136 A * 12/1992 Pietrantoni et al. ..... 72/101
6,202,461 B1 * 3/2001 Brinkman ..... 72/104
6,508,095 B1 * 1/2003 Brinkman et al. ..... 72/104

FOREIGN PATENT DOCUMENTS

DE 19934393 * 2/2001 ..... B23B/51/08

* cited by examiner

*Primary Examiner*—Ed Tolan
(74) *Attorney, Agent, or Firm*—Phillips Lytle LLP

(57) ABSTRACT

A tangential rolling attachment (20) for a machine tool, broadly includes a body (21); a pair of arms (22L, 22R) having their proximal marginal end portions (23L, 23R) pivotally mounted on the body and having distal marginal end portions (24L, 24R). The arms are biased to move in opposite angular directions such that the distal marginal end portions thereof will be urged to move away from one another. A roll (28L, 28R) is mounted on the distal marginal end portion of each arm for imparting an action to a workpiece when the attachment is moved to tangentially engage the workpiece. A wedge (29) is mounted on the body for movement relative thereto in a direction parallel to the longitudinal axis of the workpiece. An actuator (30) mounted on the body for selectively moving the wedge relative to the body to vary the spacing between the axes of the rolls. The improved rolling head may also incorporate a quick-release mechanism (33L, 33R) for mounting a roll on the arm of the machine tool attachment.

12 Claims, 3 Drawing Sheets

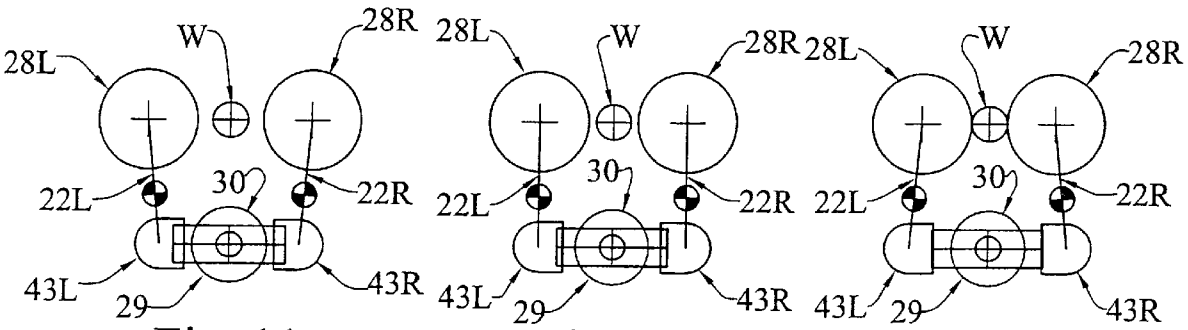
Fig. 13
Fig. 12
Fig. 11
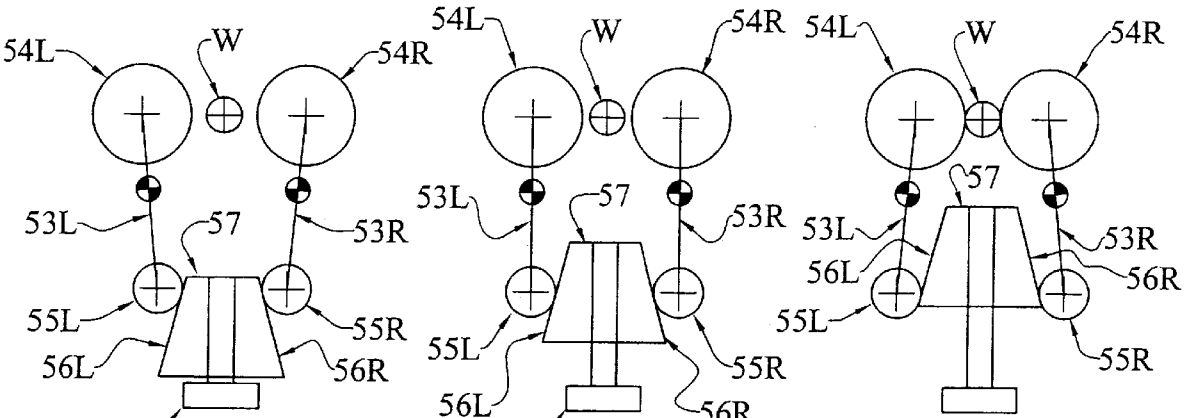
Fig. 10 (PRIOR ART)
Fig. 9 (PRIOR ART)
Fig. 8 (PRIOR ART)

TANGENTIAL ROLLING ATTACHMENT FOR A MACHINE TOOL

TECHNICAL FIELD

The present invention relates generally to devices for imparting a surface or finish to a workpiece, and, more particularly, to an improved tangential rolling head that is adapted to be mounted on a machine tool for selectively rolling a thread onto a workpiece.

BACKGROUND ART

Many bodies and workpieces have external threads formed thereon. These threaded portions are typically no longer machined on the body. Rather, they are commonly formed by impressing a thread roll on the body blank. The thread roll will then crushingly deform the blank so as to impart the desired thread pattern thereto.

There are different types of devices for rolling threads. Their use depends largely on the location and presentation of the portion of the blank on which the thread is to be impressed. Some thread-rolling attachments are of the transverse-approach radial-infeed pinch-type attachment. These devices generally contemplate that two thread rolls be placed adjacent the portion of the blank on which the thread is to be impressed, and that a suitable actuator be operated to move the thread rolls radially inwardly so as to engage the workpiece. In some cases, the device has a body, with two intermediately-pivoted arms mounted thereon. Each arm has a proximal end, which may be provided with a roller, and has a distal end on which the thread roll is mounted. The actuator controllably drives a wedge-like member between the rollers on the proximal ends so as to selectively cause the thread rolls on the distal ends to move radially inwardly toward one another. In this form, the wedge is generally oriented for movement toward and away from the axis of the workpiece. Of course, a suitable mechanism, such as a return spring, biases the two thread rolls to move away from another when the wedge is withdrawn. In these cases, the wedge is generally oriented for movement toward and away from the longitudinal axis of the workpiece.

Other types of devices contemplate that the device approach the workpiece axially, rather than transversely. Once moved to the desired axial position relative to the workpiece, the device is then operated to cause the rolls to move radially inwardly so as to impress their form onto the workpiece. One example of this is shown and described in published International Patent Application No. PCT/US00/06454, filed 10, Mar. 2000, International Publication No. WO 01/68288 A1, published 20, Sep. 2001. This published application is owned by the assignee of the present application.

Another type of device is one in which the thread rolls approach the workpiece tangentially. This type of device is representatively shown and described in U.S. Pat. No. 5,784,912, which is facially assigned to Wilhelm Fette GmbH. This patent appears to show a thread rolling attachment for a machine tool. With parenthetical reference to the reference numerals used therein, the attachment appears to have a body (10) with two arms (28,30), pivotally mounted thereon. Thread rolls (32,36) are mounted on the distal ends of the arms. An adjusting mechanism (72) is used to vary the centerline spacing between the two thread rolls. This device has another spring section (82) that is used to adjust the centerline spacing between the two thread rolls. The reason for this is that when adjusting screw (72) is operated, the centerline spacing becomes misaligned with respect to a tangential infeed with respect to a workpiece.

Still other types of thread rolls, and actuating devices therefor, are shown and described a publication "Thread Rolling Solutions", C. J. Winter Machine Technologies, Inc., Rochester, N.Y. (2000).

Accordingly, the general object of the invention is to provide an improved device for imparting a surface treatment (e.g., a threaded portion, a knurled portion, a burnished portion, etc.) to a workpiece, and, more particularly, to an improved tangential rolling attachment that is adapted to be mounted on a machine tool for selectively rolling a thread, or some other desired surface, onto a workpiece.

DISCLOSURE OF THE INVENTION

With parenthetical reference to the corresponding parts, portions or surfaces of the disclosed embodiment, merely for purposes of illustration and not by way of limitation, the present invention, in one aspect, broadly provides an improved tangential rolling attachment for a machine tool.

In this first aspect, the improved attachment (20) broadly includes a body (21); a pair of intermediately-pivoted arms (22L, 22R) having their proximal end portions (23L, 23R) pivotally mounted on the body and having distal marginal end portions (24L, 24R), the arms being biased to move in opposite angular directions such that the distal marginal end portions will be urged to move away from one another; a roll (e.g., a thread roll, a knurling roll, a burnishing roll, etc.) (28L, 28R) mounted on the distal marginal end portion of each arm for imparting a surface treatment to a workpiece when the attachment is moved to tangentially engage the workpiece; a wedge (29) mounted on the body for movement relative thereto in a direction parallel to the longitudinal axis of the workpiece; and an actuator (30) mounted on the body for selectively moving the wedge relative to the body to vary the spacing between the axes of the rolls.

In the preferred embodiment, the wedge (29) has inclined surfaces (46L, 46R), and pivotal shoes (43L, 43R) are mounted on the arms to engage the wedge surfaces in area (as opposed to point or line) contact. The wedge may be configured as an isosceles trapezoid. The inclined surfaces of the wedge may be operatively arranged such that the rolls will move symmetrically with respect to a line normal to a line between the roll axes and the wedge is moved relative to the body. The attachment may possibly be configured for mounting on a circumferential station of a turret. The invention may further comprise a quick-release mechanism (33L, 33R) operatively arranged between at least one of the arms and its associated roll. In the preferred from, each roll is selected from a group consisting of a thread roll, a knurling roll, and a burnishing roll.

In another aspect, the invention provides an improved quick-release mechanism (33L, 33R) for mounting a roll on the arm of a machine tool attachment. This improved mechanism broadly includes a body (21) having an opening; a slide (48L, 48R) movably mounted on the body, the slide having a large-diameter opening intersecting a small-diameter opening; a spring (26L, 26R) acting between the slide and body for urging the slide to move in a direction such that the small-diameter opening will be aligned with the body hole; and wherein a pin (39L, 39R) extends outwardly from the roll, the pin being adapted to pass through the body opening when the roll is mounted on the body, the pin having an annular groove (60L, 60R); and wherein the slide is so configured and arranged that the slide may be moved between a first position at which the large-diameter opening will be aligned with the body opening to permit the pin to be passed through the body opening, and a second position at which the small-diameter opening will closely space the groove to prevent axially movement of the small-diameter pin; whereby the slide may engage the pin to prevent unintended separation of the roll from the body.

In the preferred embodiment, the roll has a through-opening, and the pin is arranged to slidably penetrate the through-opening. Moreover, a roll may be removably mounted on the associated arm without the use of any tools.

Accordingly, the general object of the invention is to provide an improved tangential rolling head for a machine tool.

Another object is to provide an improved tangential rolling head in which the outer envelope of the rolling head is substantially reduced.

These and other objects and advantages will become apparent from the foregoing and ongoing written specification, the drawings, and the appended claims.

BRIEF DESCRIPTION OF THE DRAWINGS

FIG. 8 is a schematic plan view of a wedge-roller assembly found in a conventional rolling attachment, this view showing the rolls as being in their fully-opened position FIG. 9 is a schematic plan view of the wedge-roller assembly shown in FIG. 8, this view showing the rolls as being in an intermediate or neutral position.

FIG. 10 is a schematic plan view of the wedge-roller assembly shown in FIG. 8, this view showing the rolls as being in their fully-closed position.

FIG. 11 is a schematic view of the improved wedge-roller assembly, this view showing the rolls as being in their fully-opened position.

FIG. 12 is a schematic view of the improved wedge-roller assembly shown in FIG. 11, this view showing the rolls as being in their neutral position.

FIG. 13 is a schematic view of the improved wedge-roller assembly shown in FIG. 11, this view showing the rolls as being in their fully-closed position.

DESCRIPTION OF THE PREFERRED EMBODIMENTS

Figures 1, 2, 3, 4, 5, 6:
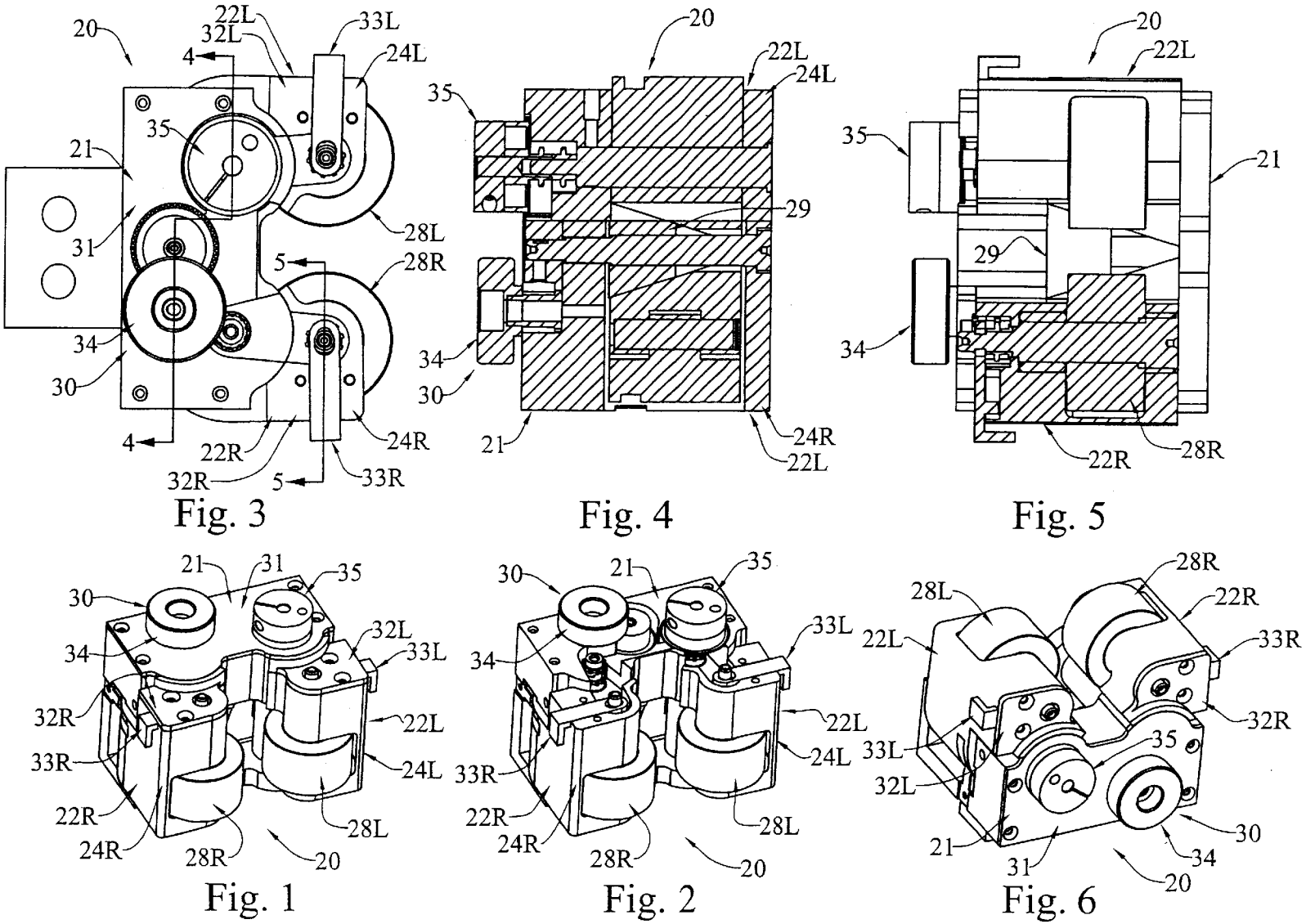
FIG. 1 is a right front perspective view of a first form of the improved tangential rolling attachment.
FIG. 2 is a view similar to FIG. 1, but with certain covers removed to illustrate the structure therebeneath.
FIG. 3 is a top plan view of the improved tangential rolling attachment shown in FIG. 1, but reoriented.
FIG. 4 is a fragmentary vertical sectional view thereof, taken generally on line 4—4 of FIG. 3.
FIG. 5 is a fragmentary vertical sectional view thereof, taken generally on line 5—5 of FIG. 3.
FIG. 6 is a left front perspective view of the attachment shown in FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention broadly provides, in a first aspect, an improved tangential rolling attachment for a machine tool (not shown), and, in a second aspect, a quick-release mechanism for mounting a roll on the arm of a machine tool attachment.

The presently-preferred form of the improved tangential rolling attachment is generally indicated at 20 in FIGS. 1–6.

FIG. 1 is a perspective view looking at the right front corner of the improved rolling attachment. FIG. 1 depicts the improved attachment as including a body 21, a pair of left and right arms 22L, 22R, respectively, having their proximal marginal end portions, indicated at 23L, 23R in FIG. 6, pivotally mounted on the body, and having distal marginal end portions 24L, 24R, respectively. The arms are biased via springs (not shown) to move in opposite angular directions such that the distal marginal end portions of these arms will be urged to move away from one another. A roll, 28L, 28R is pivotally mounted on the distal marginal end portion of each arm and is adapted to impart an action to a workpiece when the attachment is moved to tangentially engage the workpiece. The attachment is shown as further including a wedge, generally indicated at 29, mounted on the body for movement relative thereto in a direction parallel to the longitudinal axis of the workpiece to be engaged when the attachment is moved to tangentially engage the workpiece, and an actuator, generally indicated at 30, mounted on the body for selectively moving the wedge relative to the body to vary the spacing between the axes of the rolls.

FIG. 2 is a perspective view similar to FIG. 1, but with covers 31, 32L and 33R removed to show the structure therebeneath.

FIGS. 2, 3 and 5 show the quick-release mechanisms generally indicated at 33L and 33R, mounted on the distal ends of arms 22L, 22R, respectively. The attachment includes a pitch diameter adjusting knob 34 and a compensator cover 35.

Figure 7:
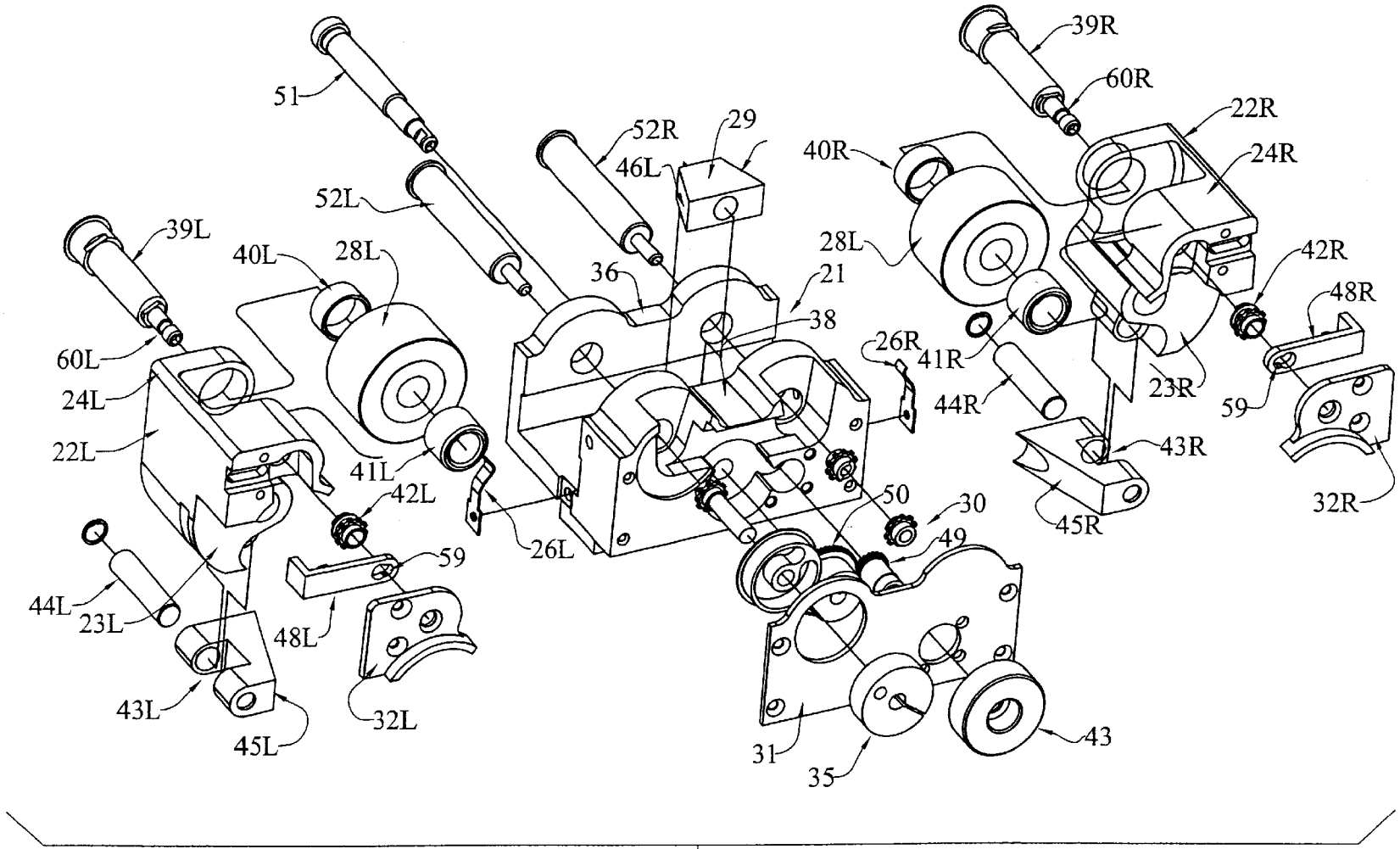
FIG. 7 is an exploded perspective view of the improved tangential rolling head, oriented as in FIG. 6.

Referring now to FIG. 7, the body is shown as being a specially-configured machined member having a transverse trough separating a rear portion 36 from a front portion 38. The left arm 22L is shown as being an assembly that broadly includes a drive pin 39L that penetrates openings in the distal marginal end portion of the arm, and carries bushings 40L, 41L on which thread roll 28L is mounted, and a sprocket 42L. The left arm assembly is also shown as including a lower shoe member 43L that is pivotally mounted on left arm 22L by means of pin 44L. It should be noted that this shoe 43L has an inclined surface 45L which is adapted to engage the facing surface 46L of the wedge in area (as opposed to point or line) contact. The left arm assembly also includes a quick-release lever 48L.

The right arm assembly is largely a mirror image of the left arm assembly and includes the same parts, portions or surfaces, although identified with the suffix "R" rather than the suffix "L". Hence, a detailed description of the right arm assembly will be omitted.

Sprockets 42L, 42R are connected by an endless chain (not shown) by means of which the relative angular positions between thread rolls 28L, 28R may be maintained.

Actuator 30 includes pitch diameter adjusting knob 34, and a gear train which includes meshing gears 49, 50 (FIG. 7). Gear 50 is arranged to rotate externally-threaded adjusting shaft 51 to selectively move the wedge relative to the body. Adjusting knob 34 is adapted to be manually rotated. This rotates the gear train including gears 49, 50, and, because of a screw thread connection, translates such rotary motion of the gear train into axial movement of adjusting shaft 51 along its longitudinal axis. The wedge is mounted on the rearward marginal end portion of adjusting shaft 51. Hence, depending on the direction of rotation of knob 34, the wedge may be translated relative to the body. The two floating shoes 43L, 43R, have their inclined surfaces 45L, 45R continuously in area sliding contact with wedge surfaces 46L, 46R, respectively. Thus, if the wedge is moved toward body rear portion 36, the rolls 28L, 28R on the intermediately-pivoted arms 22L, 22R, will be caused to move toward one another about the pivotal axes of the left and right arms, respectively. Conversely, if the adjusting knob 34 is rotated so as to move the wedge toward body front portion 38 and away from body rear part 36, the springs (not shown) will bias the distal ends of the arms to move away from one another. The left and right arms are journaled for rotation about the axes of pins 52L, 52R, respectively.

The sequence of operation of a prior art device is shown in FIGS. 8–10, and the operation of the improved device, are schematically shown in FIGS. 11–13.

In FIGS. 8–10, the prior art device is shown as having intermediately-pivoted left and right arms 53L, 53R, with thread rolls 54L, 54R mounted on their distal ends respectively. The proximal ends of these arms carry rollers 55L, 55R, respectively that engage the inclined surfaces 56L, 56R of a trapezoidal wedge member 57. An actuator, schematically indicated in FIGS. 7–9 as a thumb screw 58, is arranged to selectively move the wedge upwardly or downwardly as comparatively shown in FIGS. 8–10. Rollers 55L, 55R, engage the wedge surfaces in line contact. Moreover, the wedge was positioned to be moved toward and away from a workpiece W positioned between the rolls. Thus, FIG. 8 depicts the prior art apparatus when the wedge was fully retracted, such that the centerline spacing between the rolls was at a maximum value. When the wedge was thereafter moved upwardly to an intermediate position, the centerline spacing between the thread rolls would be reduced, as shown as in FIG. 9. When the wedge was moved further in the direction toward the workpiece, the centerline spacing between the rolls would be further reduced, as shown in FIG. 10, this sequence of operation illustrating how the rolls would be moved toward one another to impart their form onto the workpiece. The salient feature of FIGS. 8–10 is that the wedge was movable axially toward and away from the workpiece. This configuration provided the thread roll attachment with a relatively large envelope.

The sequence of operation of the improved attachment is comparatively shown in FIGS. 11–13. In these figures, the thread rolls are indicated at 28L, 28R, the intermediately-pivoted arms are indicated at 22L, 22R, and the pivoted shoes are again indicated at 43L, 43R, respectively. However, in this form, the wedge is not oriented so as to be moved toward and away from the workpiece, as shown in FIGS. 8–10. Rather, the wedge is arranged to move in a direction parallel to the longitudinal axis of the workpiece (i.e., into and out of the plane of the paper).

Thus, when the wedge is retracted, as shown in FIG. 11, the centerline spacing between the thread rolls 28L, 28R is at a maximum. When the wedge is extended to an intermediate position, as shown in FIG. 1 1, the centerline spacing between the thread rolls is reduced, as shown in FIG. 12. Finally, when the wedge is fully extended, as shown in FIG. 13, the centerline spacing between the thread rolls is further reduced so that the rolls with crush the workpiece so as to impress their form thereon. Thus, the salient distinction between the prior art arrangement shown in FIGS. 8–10 and the improved arrangement shown in FIGS. 11–13 is the axis of wedge movement. In the prior art arrangement shown in FIGS. 7–9, the wedge moves in a direction toward and away from the axis of the workpiece. In the improved arrangement, the wedge moves in a direction parallel to a workpiece axis. This allows the envelope and packaging of the improved thread roll attachment to be substantially reduced, which is an improved feature when the attachment is to be used in tightly-confined areas. The configuration of the wedge and the height of the arms permits the overall configuration to be reduced in sized. This permits the attachment to be mounted on the periphery of turret lathe, rather than on the face.

This allows the forces that are generated during rolling to be translated radially back into the turret. This is the preferred way of transmitting forces to the turret since it eliminates bending moments and the like.

As noted above, another aspect of this invention is to provide an improved quick-release mechanism for quickly mounting a roll on the arm of a machine tool. This quick-release mechanism, generally indicated at 33L, 33R, includes slides, 48L, 48R, springs 26L, 26R, and pins 38L, 38R, respectively. The slide has a specially-configured opening 59 that includes a large-diameter opening that intersects a smaller diameter opening. The spring acts between the slide and body for urging the slide to move in a direction such that the small-diameter portion of the opening will be aligned with the body hole. Pins 38L, 38R, respectively, extend outwardly from the associated roll. In the illustrated form, the pin penetrates the roll. However, in an alternative form, the pin might extent axially outwardly from one end of the roll. In other event, the pin is adapted to pass through the body opening. Each pin is shown as having an annular groove, indicated at 60L, 60R, respectively. The slide is so configured and arranged that the slide may be moved between a first position at which the large-diameter portion of the opening will be aligned with the body opening to permit the pin to be passed through the body opening, and a second position at which the small-diameter portion of the slide opening will closely face grooves 60L, 60R to prevent unintended axial movement of the pin.

Thus, an operator may simply move the slide inwardly, overcoming the bias of the spring, to align the large-diameter portion of the slide opening with the pin. Once in this position, the operator may quickly withdraw the pin through the slide, and may then remove the roll from the arm. To insert a new roll, the operator must first insert the pin through the roll and bushings, to move the slide to the position at which the large-diameter portion of the slide opening is aligned with the body opening, push the pin therethrough, and then release the slide such that the small-diameter portion of the body opening will move to closely face the groove in the pin. Once in this position, the pin is restrained from being unintentionally withdrawn from the associated arm.

MODIFICATIONS

Both aspects of the present invention expressly contemplate that many changes and modifications may be made.

For example, while the thread rolling attachment is shown in great detail in the accompanying drawings, the structure and configuration of the various parts and components thereof may be readily changed and modified as desired. For example, the bushings may possibly be omitted, the configuration of the arms may be changed or modified. The configuration of the actuator may be changed, as desired. As indicated, the pin may penetrate the rolls, or a portion of a pin-like projection may extend outwardly from one end of the rolls, as desired. Therefore, while the presently-preferred form of the improved attachment and quick-release mechanism have been shown and described, and various changes and modifications thereof discussed, persons skilled in this art will readily appreciate that various additional changes and modifications may be made without departing from the spirit of the invention, as defined and differentiated by the following claims.

What is claimed is:

1. A tangential rolling attachment for a machine tool, comprising:

a body;

a pair of arms having their proximal marginal end portions pivotally mounted on said body and having distal marginal end portions, said arms being biased to move in opposite angular directions such that said distal marginal end portions will be urged to move away from one another;

a roll mounted on the distal marginal end portion of each arm for imparting an action to a workpiece when said attachment is moved to tangentially engage said workpiece;

a wedge mounted on said body for movement relative thereto in a direction parallel to the longitudinal axis of said workpiece; and an actuator mounted on said body for selectively moving said wedge relative to said body to vary the spacing between the axes of said rolls.

2. A tangential rolling attachment as set forth in claim 1 wherein said wedge has inclined surfaces, and further comprising pivotal shoes mounted on said arms and engaging said wedge surfaces in area contact.

3. A tangential rolling attachment as set forth in claim 1 wherein said wedge has inclined surfaces operatively arranged such that said rolls will move symmetrically with respect to a line normal to a line between said roll axes when said wedge is moved relative to said body.

4. A tangential rolling attachment as set forth in claim 1 wherein said attachment is configured for mounting on a circumferental station of a turret.

5. A tangential rolling attachment as set forth in claim 1 and further comprising a quick-release mechanism operatively arranged between one of said arms and its associated roll.

6. A tangential rolling attachment as set forth in claim 5 wherein said body has an opening, and flier comprising:

a slide movably mounted on said body, said slide having an opening defined by a large-diameter portion intersecting a small-diameter portion;

a spring acting between said slide and body for urging said slide to move in a direction such that said small-diameter portion will be aligned with said body hole; and wherein a pin extends outwardly from said roll, said pin being adapted to pass through said body opening when said roll is mounted on said body, said pin having an annular groove, and wherein said slide is so configured and arranged that said slide may be moved between a first position at which said large-diameter portion will be aligned with said body opening to permit said pin to be passed through said body opening, and a second position at which small-diameter portion will closely face said groove to prevent unintended axial movement of pin relative to said body;

whereby, said slide may engage said pin to prevent unintended separation of said roll from said body.

7. A tangential rolling attachment for a machine tool as set forth in claim 6, wherein said roll has a through-opening, and wherein said pin is arranged to slidably penetrate said through-opening.

8. A tangential rolling attachment for a machine tool as set forth in claim 1 wherein said actuator comprises a rotatable knob mounted on said body, and a gear train operatively interposed between said knob and wedge such that rotational movement of said knob will cause linear movement of said wedge.

9. A tangential rolling attachment as set forth in claim 1 wherein at least one of said rolls may be removably mounted on the associated arm without the use of any tools.

10. A tangential rolling attachment as set forth in claim 1 wherein each roll is selected from the group consisting of a thread roll, a knurling roll and a burnishing roll.

11. A quick-release mechanism for mounting a roll on the arm of a machine tool attachment, comprising:

said attachment including a body having an opening;

a slide movably mounted on said body, said slide having an opening defined by a large-diameter portion intersecting a small-diameter portion;

a spring acting between said slide and body for urging said slide to move in a direction such that said small-diameter portion will be aligned with said body hole; and wherein a pin extends outwardly from said roll, said pin being adapted to pass through said body opening when said roll is mounted on said body, said pin having an annular groove, and wherein said slide is so configured and arranged that said slide may be moved between a first position at which said large-diameter portion will be aligned with said body opening to permit said pin to be passed through said body opening, and a second position at which said small-diameter portion will closely face said groove to prevent unintended axial movement of said pin relative to said body;

whereby, said slide may engage said pin to prevent unintended separation of said roll from said body.

12. A quick-release mechanism for mounting a roll on the arm of a machine tool attachment as set forth in claim 11, wherein said roll has a through-opening, and wherein said pin is arranged to slidably penetrate said through-opening.

* * * * *